US007137576B2

(12) United States Patent
Xu

(10) Patent No.: US 7,137,576 B2
(45) Date of Patent: Nov. 21, 2006

(54) FUEL INJECTOR NOZZLE ASSEMBLY

(75) Inventor: Min Xu, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 24 days.

(21) Appl. No.: 10/932,592

(22) Filed: Sep. 2, 2004

(65) Prior Publication Data

US 2005/0023381 A1 Feb. 3, 2005

Related U.S. Application Data

(62) Division of application No. 10/043,367, filed on Jan. 9, 2002, now Pat. No. 6,817,545.

(51) Int. Cl.
*F02M 61/00* (2006.01)

(52) U.S. Cl. ..... 239/533.12; 239/533.2; 239/596; 239/597; 239/601

(58) Field of Classification Search ..... 239/596, 239/533.12, 533.2, 597, 601, 585.1–585.5, 239/900

See application file for complete search history.

(56) References Cited

U.S. PATENT DOCUMENTS

| | | | | |
|---|---|---|---|---|
| 4,018,387 A | | 4/1977 | Erb et al. | |
| 4,907,748 A | | 3/1990 | Gardner et al. | |
| 5,244,154 A | | 9/1993 | Buchholz et al. | |
| 5,285,970 A | * | 2/1994 | Maier et al. | 239/533.12 |
| 5,383,597 A | * | 1/1995 | Sooriakumar et al. | 239/5 |
| 5,449,114 A | * | 9/1995 | Wells et al. | 239/5 |
| 5,553,789 A | * | 9/1996 | Findler et al. | 239/548 |
| 5,626,295 A | | 5/1997 | Heyse et al. | |
| 5,762,272 A | | 6/1998 | Tani et al. | |
| 5,881,957 A | * | 3/1999 | Mizuno et al. | 239/533.2 |
| 5,911,366 A | | 6/1999 | Maier et al. | |
| 6,170,763 B1 | | 1/2001 | Fuchs et al. | |
| 6,330,981 B1 | * | 12/2001 | Nally et al. | 239/533.12 |
| 6,405,946 B1 | | 6/2002 | Harata et al. | |
| 6,616,072 B1 | | 9/2003 | Harata et al. | |

FOREIGN PATENT DOCUMENTS

| | | |
|---|---|---|
| EP | WO 93/20349 | 10/1993 |
| EP | WO 95/04881 | 2/1995 |
| JP | 2001-046919 | 2/2001 |

* cited by examiner

*Primary Examiner*—Dinh Q. Nguyen
(74) *Attorney, Agent, or Firm*—Brinks Hofer Gilson & Lione

(57) ABSTRACT

A fuel injector nozzle assembly includes an injector body including a valve seat with a supply passage through which fuel flows generally along a supply axis. The valve seat presents an upper surface which is adapted to engage a valve to seal the supply passage. A nozzle plate is mounted onto the valve seat and includes a plurality of orifice holes therein through which fuel flows. The valve seat further includes a first edge protrusion protruding into the fuel flow for generating a first separation of the fuel flow, thereby creating a plurality of small eddies which are entrained within the fuel flowing adjacent thereto. A turbulence cavity is defined by the nozzle plate and the valve seat wherein fuel flows into the turbulence cavity through the supply passage and out from the turbulence cavity through the plurality of orifice holes.

13 Claims, 5 Drawing Sheets

FUEL INJECTOR NOZZLE ASSEMBLY

RELATED APPLICATION

This application is a divisional of application Ser. No. 10/043,367 filed Jan. 9, 2002 now U.S. Pat. No. 6,817,545.

TECHNICAL FIELD OF THE INVENTION

The present invention generally relates to a fuel injector nozzle for providing fine atomization of fuel expelled into an internal combustion engine.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold start capabilities, fuel consumption and performance. Traditionally, fine atomization of the fuel is achieved by injecting the fuel at high pressures. However, this requires the use of a secondary high pressure fuel pump which causes cost and packaging concerns. Additionally, injecting the fuel at high pressure causes the fuel to propagate into the piston cylinder causing wall wetting and piston wetting concerns. Low pressure direct injection systems do not present the wall wetting and piston wetting problems associated with high pressure systems, however, a current high pressure injector nozzle operated at low pressure does not provide optimum fuel atomization. Therefore, there is a need in the industry for a fuel injector nozzle which will provide fine atomization of the fuel at low fuel flow pressures.

DETAILED DESCRIPTION OF THE PREFERRED EMBODIMENTS

The following description of the preferred embodiment of the invention is not intended to limit the scope of the invention to this preferred embodiment, but rather to enable any person skilled in the art to make and use the invention.

Figure 1:
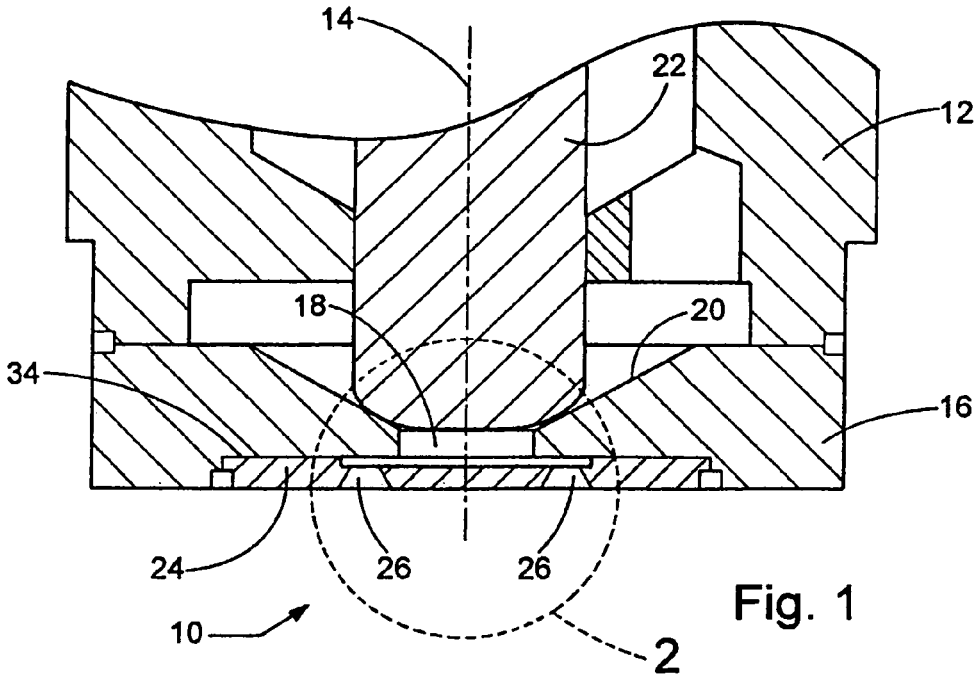
FIG. 1 is a cross sectional view of a first preferred embodiment of a fuel injector nozzle assembly of the present invention.
Figure 2:
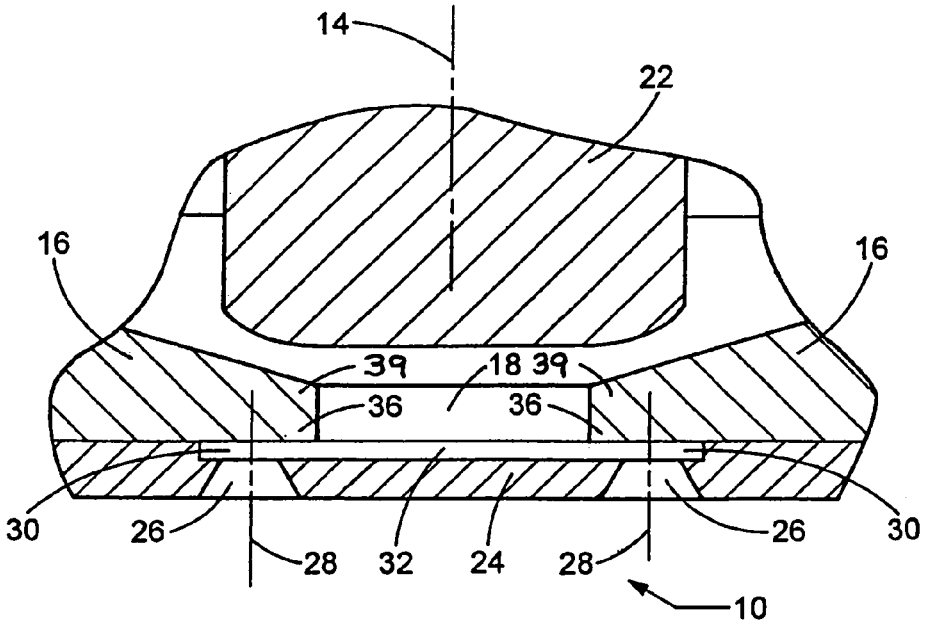
FIG. 2 is a close up view of a portion of FIG. 1 shown where an axis of the orifice holes is parallel with a supply axis.

Referring to FIGS. 1 and 2, a fuel injector nozzle assembly of the preferred embodiment of the present invention is shown generally at 10. The fuel injector nozzle assembly 10 includes an injector body 12 which defines a supply axis 14 through which fuel flows. A distal end of the injector body 12 defines a valve seat 16. The valve seat 16 has a supply passage 18 through which fuel flows outward from the injector body 12. An upper surface 20 of the valve seat 16 is adapted to engage a valve 22 to selectively seal the supply passage 18 to block the flow of fuel from the injector body 12.

A nozzle plate 24 is mounted onto the valve seat 16 and includes a plurality of orifice holes 26 extending therethrough which are adapted to allow fuel to flow outward. In the preferred embodiment, the nozzle plate 24 is made from metal, and is welded onto the valve seat 16. Specifically, the nozzle plate 24 is preferably made from stainless steel, and is attached to the valve seat 16 by laser welding.

Preferably, the orifice holes 26 within the nozzle plate 24 are round and conical, extending downward such that the narrow end of the conical orifice holes 26 are adjacent the valve seat 16. Therefore, the orifice holes 26 have no vena contracta, or hourglass like shape, and therefore, an orifice discharge coefficient of one. The fuel flowing through the orifice holes 26 can freely expand inside the conical orifice hole 26 without suppression. Due to the rapid flow expansion at the sharp edge of the orifice holes 26, cavitation and separation occurs right below the sharp edge, which greatly induces external disturbance on the freshly generated jet surface to prevent re-lamination of the flow by the walls of the orifice holes 26 and enhancing the atomization of the fuel. The round orifice hole has advantages over other shapes. For instance, square orifice holes allow thick liquid rims to form within the sharp corners of the square. Surface tension of the fuel will cause the square jet of fuel to transform into a round jet, thus allowing large droplets to form at the corners. These large droplets cause reduced combustion efficiency and increased emissions. Round orifice holes 26 do not provide the sharp square corners, and therefore do not provide the opportunity for large droplets to be formed by surface tension of the fuel.

Figure 3:
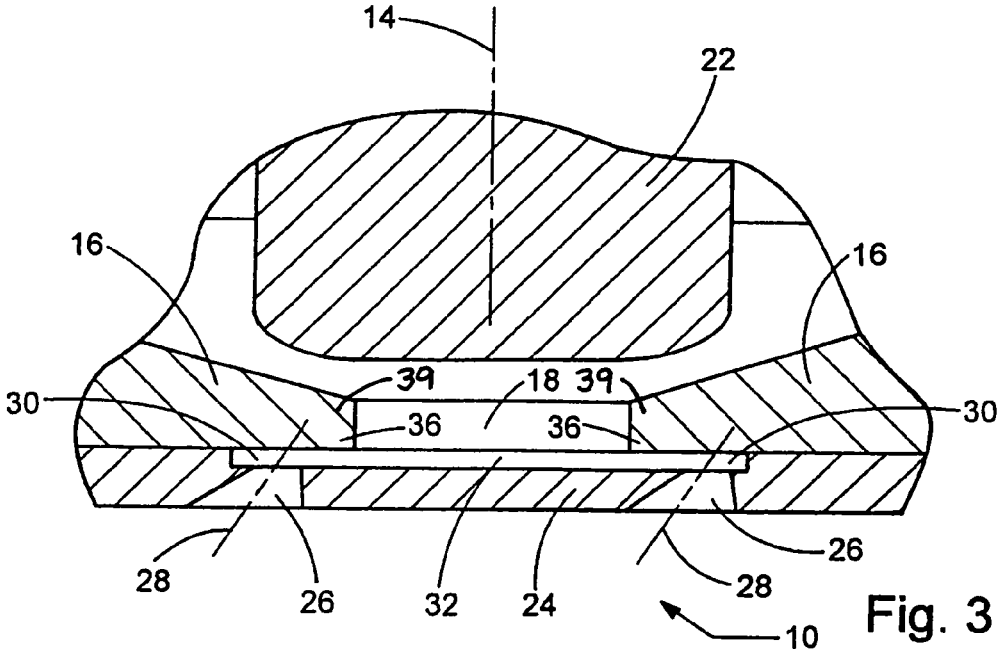
FIG. 3 is a close up view of a portion of FIG. 1 shown where the axis of the orifice holes is skewed with respect to the supply axis.

The cone angle of the conical orifice holes 26 can be adjusted to change the spray angle of the fuel. Referring to FIG. 2, the conical orifice holes 26 include an axis 28 which is parallel to the supply axis 14. However, the axis 28 of the conical orifice holes 26 can also be skewed relative to the supply axis 14 as shown in FIG. 3 to meet particular packaging and targeting requirements of the injector assembly 10. In conventional nozzles, alterations to the spray angle, and skewing the spray relative to the axis of the injector will typically have a corresponding affect on the spray quality. The nozzle assembly 10 of the present invention can be tailored for spray angle and skew relative to the injector axis 14 with minimal corresponding affect on the spray quality, by orienting the conical orifice holes 26 at an angle relative to the injector axis14.

The nozzle plate 24 and the valve seat 16 define a turbulence cavity 30. More specifically, the turbulence cavity 30 is defined by an annular section extending between the valve seat 16 and the nozzle plate 24 such that fuel flows generally from the supply passage 18 into the turbulence cavity 30 and outward from the turbulence cavity 30 through the orifice holes 26 in the nozzle plate 24. Preferably the nozzle plate 24 includes a first recess 32 formed within a top surface of the nozzle plate 24. In the preferred embodiment the first recess 32 is circular in shape, wherein when the nozzle plate 24 is mounted onto the valve seat 16 the turbulence cavity 30 is defined by the first recess 32 and the valve seat 16. It is to be understood that the first recess 32 could also be other shapes such as an oval or ellipse shaped depending upon the spray characteristics required for the particular application.

Figure 4:
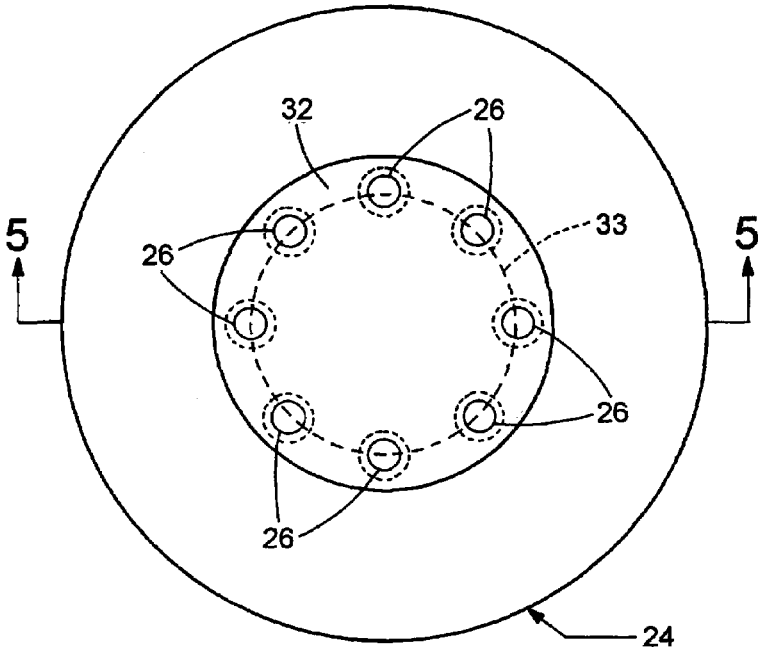
FIG. 4 is a top view of a nozzle plate of the first preferred embodiment where the orifice holes are in a circular pattern.
Figure 5:
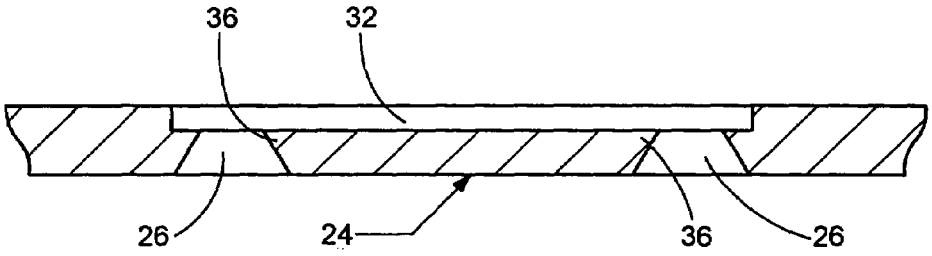
FIG. 5 is a side cross sectional view of the nozzle plate shown in FIG. 3.
Figure 6:
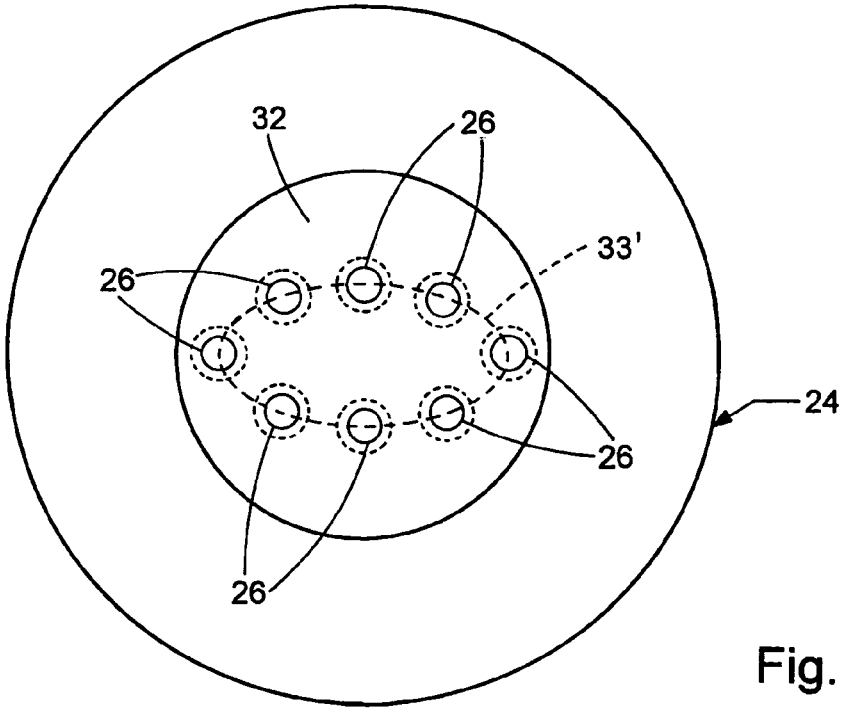
FIG. 6 is a top view of a nozzle plate of the first preferred embodiment where the orifice holes are in an oval pattern.

Referring to FIGS. 4 and 5, in the preferred embodiment the plurality of orifice holes 26 are evenly distributed along a circular pattern 33 within the first recess 32. The circular pattern 33 on which the orifice holes 26 are distributed is preferably concentric with the first recess 32, but could also be offset from the center of the first recess 32. The circular pattern 33 has a diameter which is less than the first recess 32 such that the orifice holes 26 are in fluid communication with the turbulence cavity 30. Referring to FIG. 6, the orifice holes could also fall on an oval pattern 33'. It is to be understood that the pattern of the orifice holes 26 could be any suitable pattern and is to be determined based upon the required spray characteristics of the particular application.

The number of orifice holes 26 depends upon the design characteristics of the injector assembly 10. By changing the number of orifice holes 26 within the nozzle plate 24 the flow rate of the injector assembly 10 can be adjusted without affecting the spray pattern or droplet size of the fuel. In the past, in order to adjust the flow rate, the pressure would be increased or decreased, or the size of the orifice adjusted, either of which would lead to altered spray characteristics of the fuel. The present invention allows the flow rate of the injector assembly 10 to be adjusted by selecting an appropriate number of orifice holes 26 without a corresponding deterioration of the spray. By including additional orifice holes 26 with the same dimensions, the total amount of fuel flowing is increased. However, each individual orifice hole 26 will produce identical spray characteristics, thereby maintaining the spray characteristics of the overall flow.

Preferably, the valve seat 16 includes a second recess 34 formed within a bottom surface therein. The shape of the second recess 34 corresponds to the shape of the nozzle plate 24 so the nozzle plate 24 can be received within the second recess 34 and welded in place. In the preferred embodiment, the nozzle plate 24 is circular, and the second recess 34 is circular having a depth equal to the thickness of the nozzle plate 24. The overall diameter of the nozzle plate 24 is determined based upon the overall design of the assembly 10. The diameter must be large enough to prevent deformation of the orifice holes 26 by the laser welding when the nozzle plate is welded to the valve seat 16, however the diameter must also be small enough to minimize plate deflection under pressure to insure that there is no separation between the nozzle plate 24 and the valve seat 16. Alternatively, the valve seat 16 could be flat, with no recess, wherein the nozzle plate 24 is welded onto the bottom surface of the valve seat 16. The presence of the second recess 34 is optional.

Referring again to FIG. 2, the valve seat 16 includes a first edge protrusion 36 protruding into the fuel flow. The first edge protrusion 36 generates a vortex turbulence in the fuel flowing adjacent thereto. Preferably, the first edge protrusion 36 comprises an edge of a circumferential lip section of the valve seat 16 which defines a generally circular lower neck section of the supply passage 18 therein. The valve seat 16 also includes a second edge protrusion 39 located upstream of the first edge protrusion 36.

Figure 7:
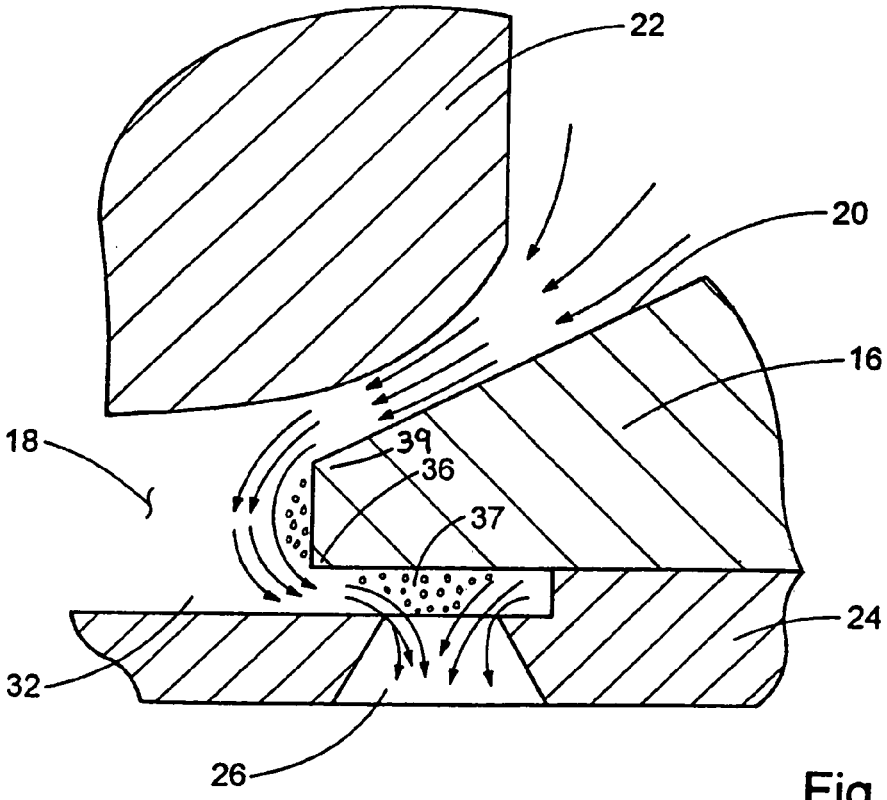
FIG. 7 is a close up view of FIG. 2 showing fuel flow and separation boundary formations.

Referring to FIG. 7, the first edge protrusion 36 causes the fuel flow to separate from the upper wall of the turbulence cavity 30 forming a separation boundary 37. The separation boundary is formed because the flow is bending very sharply around the first edge protrusion 36. The flow cannot follow the sharp bend of the first edge protrusion 36, and therefore separates from the upper wall of the turbulence cavity 30. Within the separation boundary 37, many small eddies are formed which are entrained into the main fuel flow, thereby causing additional turbulence within the main fuel flow.

The separation caused by the first edge protrusion 36 is immediately upstream of the orifice holes 26, therefore, the eddies that are formed within the boundary separation 37 adjacent the first edge protrusion 36 are entrained directly into the main flow that is entering the orifice holes 26, thereby creating additional turbulence within the flow to improve the atomization of the fuel passing through the orifice holes 26.

The proximity of the first edge protrusion 36 to the orifice holes 26 causes the eddies formed within the separation boundary 37 to be entrained within the fuel flowing into the orifice holes 26. This additional turbulence within the main fuel flow causes rapid breakup of the liquid jet which contributes to smaller droplet size within the fuel spray. This is what allows the spray and droplet size of the fuel to be controlled. Rather than using turbulence kinetic energy from a high pressure flow, the present invention uses turbulence from the eddies which are created by the flow separation at the first edge protrusion 36 and are entrained within the main fuel flow.

An advantage of the present invention over the prior art is the single piece nozzle plate 24 which is mounted directly to the valve seat 16. In the present invention, the injector sac volume is reduced to the volume of the turbulence cavity 30 and the supply orifice 18. Minimal sac volume is always preferred for eliminating initial fuel slag ahead of the main spray and dribbling after the end of injection.

Figure 8:
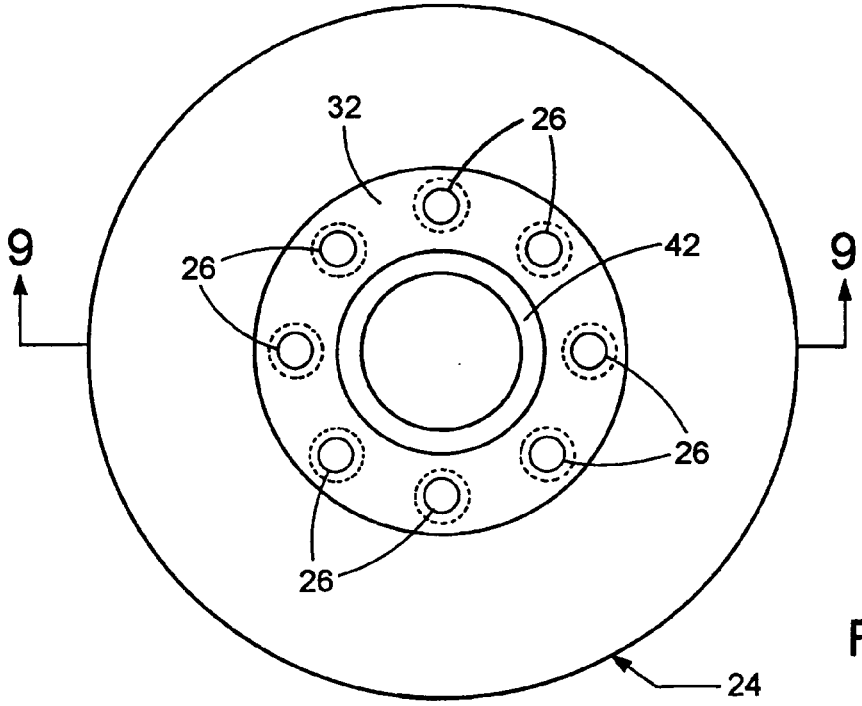
FIG. 8 is a top view of a nozzle plate of a second preferred embodiment.
Figure 9:
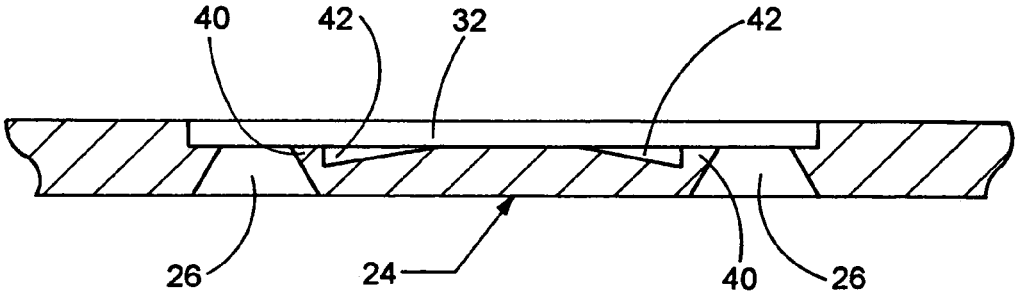
FIG. 9 is a side cross sectional view of the nozzle plate shown in FIG. 8.

Referring to FIGS. 8 and 9, in a second preferred embodiment of the present invention, nozzle plate 24 includes a second edge protrusion 40 protruding into the fuel flow. The second edge protrusion 40 generates a vortex turbulence in the fuel flowing adjacent thereto. Preferably, the second edge protrusion 40 is defined by a channel 42 formed within the nozzle plate 24 adjacent the orifice holes 26.

Figure 10:
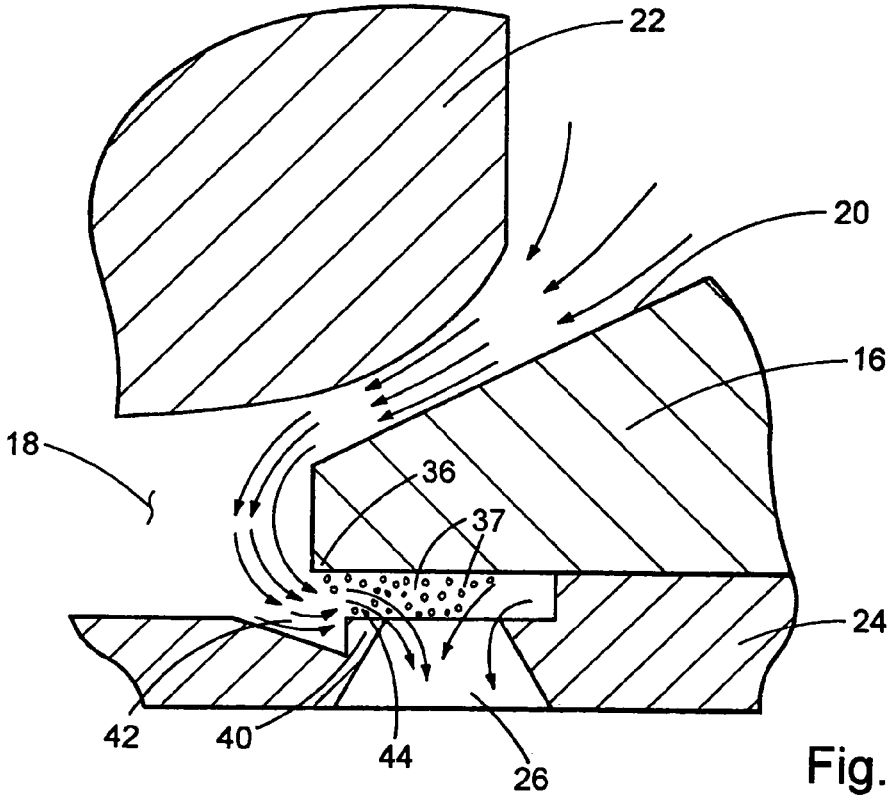
FIG. 10 is a close up view of the second preferred embodiment showing fuel flow and separation boundary formations.

Referring to FIG. 10, the second edge protrusion 40 causes the fuel flow to separate from the nozzle plate 24 forming a second separation boundary 44. The second separation boundary 44 is formed because the flow is forced upward very sharply as the flow moves across the channel 42. The flow is then bent very sharply around the second edge protrusion 40 prior to entering the orifice holes 26. The flow cannot follow the sharp bend of the second edge protrusion 40, and therefore separates from the nozzle plate 24. Within the second separation boundary 44, many small eddies are formed which are entrained into the main fuel flow, thereby causing additional turbulence within the main fuel flow.

The foregoing discussion discloses and describes two preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

I claim:

1. A fuel injector nozzle assembly comprising:

an injector body including a valve seat with a supply passage through which fuel flows generally along a supply axis, said valve seat presenting an upper surface adapted to engage a valve to seal said supply passage;

a nozzle plate mounted onto said valve seat including a plurality of orifice holes therein through which fuel flows, each of said orifice holes including a center line that is skewed relative to said supply axis;

said valve seat further including a first edge protrusion, protruding into the fuel flow for generating a first separation of the fuel flow, thereby creating a plurality of small eddies which are entrained within the fuel flowing adjacent thereto, said valve seat further including a second edge protrusion located upstream of said first edge protrusion and creating a plurality of small eddies; and a turbulence cavity defined by said nozzle plate and said valve seat wherein fuel flows into said turbulence cavity through said supply passage and out from said turbulence cavity through said plurality of orifice holes.

2. The fuel injector nozzle assembly of claim 1 wherein said first edge protrusion comprises a circumferential lip section of said valve seat defining said supply passage therein.

3. The fuel injector nozzle assembly of claim 1 wherein said nozzle plate is made from metal and is welded onto said valve seat.

4. The fuel injector nozzle assembly of claim 3 wherein said nozzle assembly is made from stainless steel.

5. The fuel injector nozzle assembly of claim 1 wherein said nozzle plate includes a first recess formed within a top surface of said nozzle plate, wherein said turbulence cavity is defined by said first recess and said valve seat.

6. The fuel injector nozzle assembly of claim 5 wherein said first recess is circular in shape.

7. The fuel injector nozzle assembly of claim 6 wherein said plurality of orifice holes are evenly distributed along a circular pattern, said circular pattern having a diameter smaller than said first recess, such that said orifice holes are in fluid communication with said turbulence cavity.

8. The fuel injector nozzle assembly of claim 7 wherein said circular pattern is concentric with said first recess.

9. The fuel injector nozzle assembly of claim 5 wherein said plurality of orifice holes are evenly distributed along an oval pattern within said first recess, such that said orifice holes are in fluid communication with said turbulence cavity.

10. The fuel injector nozzle assembly of claim 1 wherein said orifice holes are round.

11. The fuel injector nozzle assembly of claim 10 wherein said orifice holes are conical in shape.

12. The fuel injector nozzle assembly of claim 1 wherein said valve seat includes a second recess, wherein said nozzle plate is shaped such that said nozzle plate is received within said second recess.

13. The fuel injector nozzle assembly of claim 12 wherein said second recess and said nozzle plate are circular in shape.

* * * * *